US005435558A

United States Patent [19]

Iriarte

[11] Patent Number: 5,435,558

[45] Date of Patent: Jul. 25, 1995

[54] GOLF CLUB HEAD WITH AERODYAMIC DESIGN

[75] Inventor: D Jose J. D. Iriarte, Bilbao, Spain

[73] Assignee: Makser, S.A., Las Arenas, Spain

[21] Appl. No.: 206,529

[22] Filed: Mar. 4, 1994

[30] Foreign Application Priority Data

Mar. 4, 1993 [ES] Spain ..... 9300439

[51] Int. Cl.[6] ..... A63B 53/04

[52] U.S. Cl. ..... 273/167 E; 273/167 H

[58] Field of Search ..... 273/77 R, 162 R, 167 R, 273/167 E, 193 R, 194 R, 167 H, 167 D; D21/214–220

[56] References Cited

U.S. PATENT DOCUMENTS

| | | | |
|---|---|---|---|
| D. 275,412 | 9/1984 | Simmons | 273/167 H |
| 2,254,528 | 9/1941 | Hoare | 273/167 E |
| 3,814,437 | 6/1974 | Winquist | 273/167 H |
| 4,065,133 | 12/1977 | Gordos | 273/167 A |
| 4,444,392 | 4/1984 | Duclos | 273/167 E |
| 4,461,482 | 7/1984 | Bojicic | 273/168 |
| 4,653,756 | 3/1987 | Sato | 273/167 E |
| 5,060,949 | 10/1991 | Brill | 273/167 E |
| 5,186,465 | 2/1993 | Chorne | 273/167 E |
| 5,203,565 | 4/1993 | Murray | 273/167 E |

FOREIGN PATENT DOCUMENTS

| | | | |
|---|---|---|---|
| 404180779 | 6/1992 | Japan | 273/167 E |

*Primary Examiner*—Sebastiano Passaniti

*Attorney, Agent, or Firm*—Ostrolenk, Faber, Gerb & Soffen

[57] ABSTRACT

A golf club head of an improved aerodynamic design, which includes deep cavities for airflow stabilization. Adjacent rims of these cavities meet to form a central rib. Cavities can be joined at both ends of the rib to form a continuous cavity or can be separated along their entire length to create two different cavities and in either case run parallel to the edges of the rear face. The cavities accommodate air turbulence and swirl, and the centrifugal force produced by the swirl in those cavities in the head imparts a thrust upon it which thus minimizes drag and maximizes the force with which it strikes and drives the ball. The cavities also minimize undesired aerodynamic vibration in the golf club so as to enhance the player's accuracy.

11 Claims, 2 Drawing Sheets

GOLF CLUB HEAD WITH AERODYAMIC DESIGN

BACKGROUND OF THE INVENTION

1. Field of the Invention

The invention refers to the field of sporting goods and specifically to the aerodynamic design of a golf club head.

2. Description of the Related Art

Numerous ornamental designs for the golf club heads exist which are protected by design patents, but with respect to the scientific principles of golf club head design, see U.S. Pat. No. 4,653,756 entitled GOLF CLUB IRON, and the patents cited during the prosecution thereof, namely U.S. Pat. No. 1,690,388 to Waldron and U.S. Pat. No. 3,976,299 to Lawrence et al.

The scientific principles, which are applied to a golf club in accordance with the present invention, are described in Spanish Patent No. 9300372, entitled "IMPROVED FUSELAGE IN ORDER TO ACHIEVE STABILIZATION EFFECTS IN AIR VORTICES", filed by the present inventor. As described therein, the concept of the well accepted D'Alembert Paradox is that, if a fluid does not detach from a solid as the solid passes through the fluid, then the drag caused by the fluid is nil (the ideal frictionless fluid).

The detachment of the fluid from the solid, and hence the drag, is believed to be a phenomenon caused by a boundary layer between non-ideal, frictional fluids (flow subject to drag over the surface of the solid). Sucking or blowing this "parasite" fluid from the boundary layer is thought to minimize the problem of detachment and drag.

The present invention is based upon a recognition by the present inventors that the D'Alembert flow pattern described above is not valid from a physics standpoint because it originates and disappears at two specific points: source and sink, which means that speed in the center of the flow pattern has an infinite value. Accordingly, the present invention relates to a new flow pattern, which invalidates the currently accepted D'Alembert Paradox.

With the flow pattern developed by the present inventors, as described in Spanish Patent 9300372, the fluid, even if it is ideal and possesses zero viscosity, will detach if the solid profile is not sufficiently tapered.

Thus, bearing in mind that curved streamline patterns provide an additional radial pressure component in the form of centrifugal or centripetal force, a fairing (or part of a fairing) is required that does not hinder fluid detachment, but instead favorably controls this unavoidable phenomenon by minimizing the drag.

The above-described scientific principles are applied to a golf club head in accordance with the present invention. Specifically, FIG. 1 shows a representation of a section of the head 1 of a prior art golf club 2. When this golf club 2 is in use, the head moves through the air in a curved trajectory identified by reference numeral 3, so that its face 12 hits on the corresponding ball.

During this movement of the head 1, patterns of air flow 5 are produced that fall from and drag the head in question. As mentioned in Spanish Patent No. 9300372, air flows 5 give rise to air vortices 6 that rest on the surface 4 and cause turbulence.

The problem to be solved is to minimize the drag upon the golf club head, whose length is restricted, and which is thus insufficiently tapered, and will inexorably produce fluid detachment with resulting aerodynamic drag and vibration.

SUMMARY OF THE INVENTION

The present invention is an improvement on prior art golf club heads, and overcomes the problems noted above by providing, at the point where detachment occurs (i.e. at the rear surface of the club), a pointed rear edge to stimulate and establish the above-described detachment.

In addition to the pointed rear edge, an ideally semicircular, sectioned cavity is provided, although other concave shapes are also possible. A further pointed rear edge is formed by a central rib disposed between the first cavity and a second cavity associated with a second rear edge. Because the rear edge extends across and bounds the solid rear surface of the club in the form of an uninterrupted enclosed curve, the cavity adjacent the rear edge likewise extends across the solid in the form of an uninterrupted cavity.

Considering the existence of various types and forms of golf club heads, it is possible for design or other purposes to block the cavity at both ends of the central rib, whereupon it would become appropriate to speak in terms of two cavities.

Accordingly, the improvement of the present invention, applied to the head of the golf club, relates to the design of the fuselage and is defined by all the air flows that determine the release and consequent drag strength, and also vibrations. With the fuselage design of the present invention as applied to the head of a golf club, a great deal of the vibrations will be avoided. These vibrations are currently caused by successive air vortices generating turbulence in the rear zone of the golf club head. Thus, avoiding these vibrations increases the precision with which the golf club can be used.

The present invention advantageously provides an improvement to a golf club head at precisely the area from whence the fluid through which the club travels detaches, consisting of a novel trailing edge and a cavity adjacent to it; an improvement which minimizes drag; an improvement which minimizes vibrations; and an improvement that allows greater accuracy and distance from the player.

Other features and advantages of the present invention will become apparent from the following description of the invention which refers to the accompanying drawings.

BRIEF DESCRIPTION OF THE DRAWINGS

To complete the description given here and in order to assist in better understanding the characteristics of the invention, attached to the present descriptive memorandum, as an integral part of the same, is a set of drawings which as an illustration but not imposing any limitation show the following.

DETAILED DESCRIPTION OF THE PREFERRED EMBODIMENTS

Figure 1:
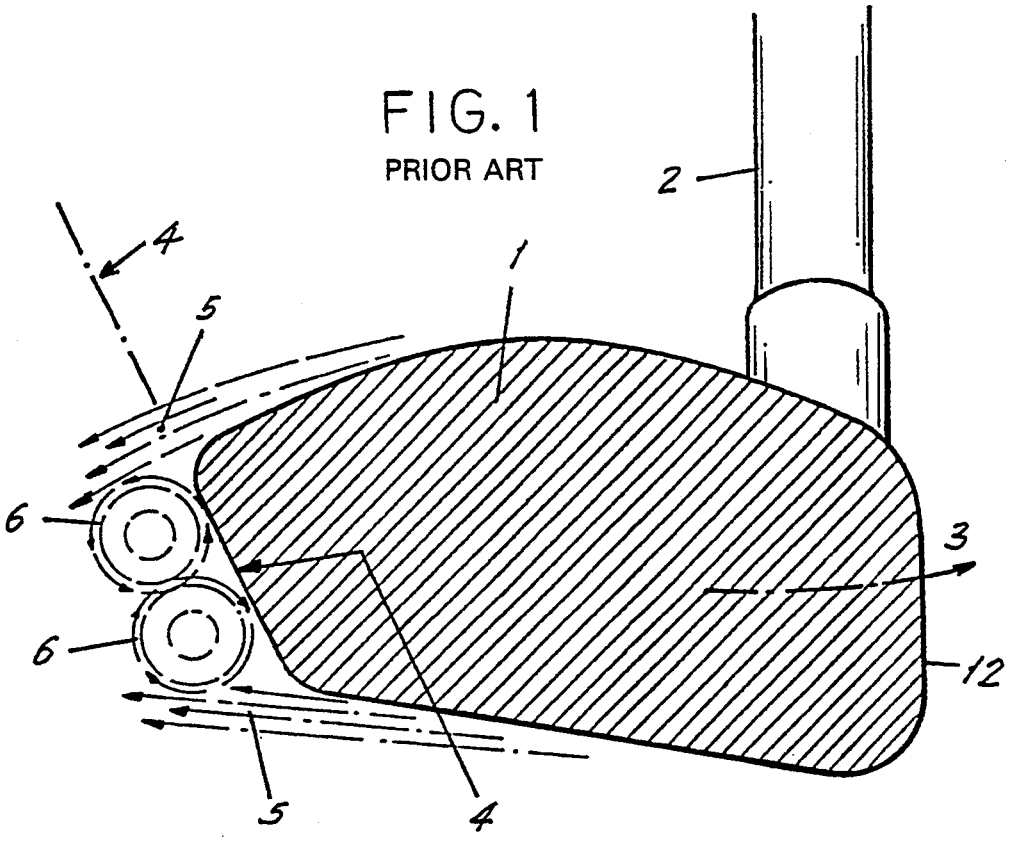
FIG. 1 PRIOR ART
FIG. 1 is a representation of the section of the head 1 of a prior art golf club.
Figure 2:
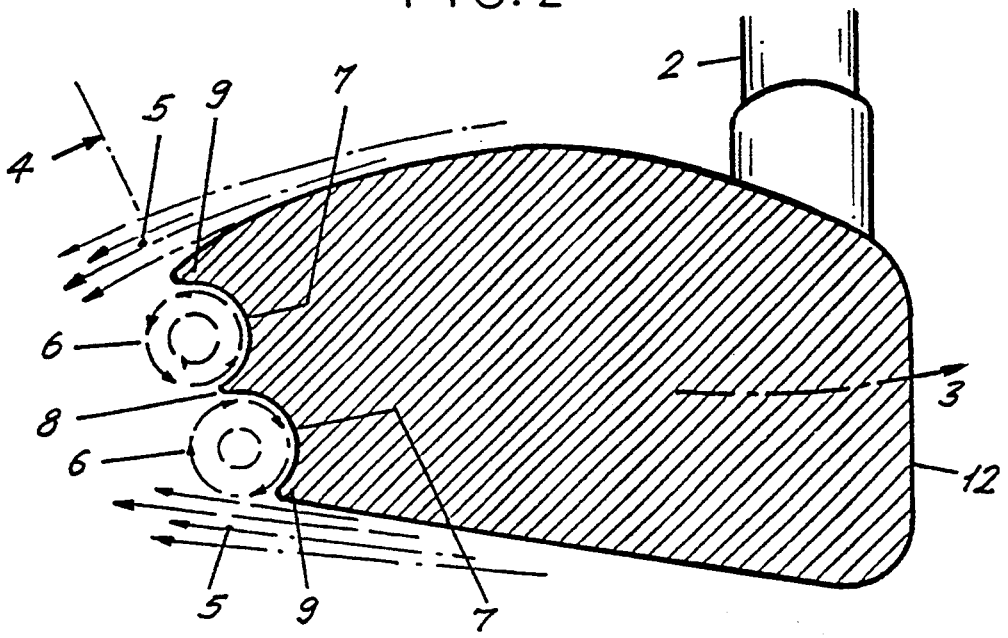
FIG. 2 is a representation of the same section of the head 1 of the golf club according to a preferred embodiment of the present invention.

The golf club head 1 of the present invention is shown in FIG. 2. This head can have different constructional designs, but the important thing in this case is the novel, modified shape of the rear of club head in accordance with the present invention.

Reference numeral 2 identifies the golf club which carries the head 1. When the golf club is swung, it follows a trajectory 3 to make impact with the face 12 on the ball.

Figure 8:
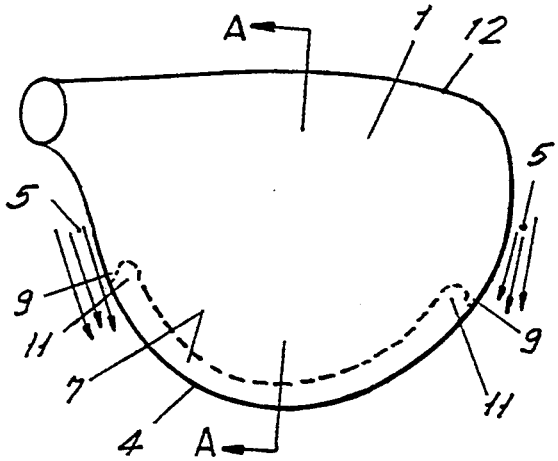
FIG. 8 is a top view of the head of the golf club, showing section A—A of FIG. 7.

The golf club head includes a rear surface 4 opposite face 12 which can be flat or, as shown in the top view of FIG. 8, curved. Rear surface 4 contains the improved fuselage design of the present invention, specifically a pair of parallel cavities 7 where the air vortices 6 from air flow 5 are held in a stable form. Cavities 7 cover the whole rear surface 4, and terminate in pointed edges 9 at the top and bottom thereof (see FIGS. 3 and 5). A pointed central rib 8 preferably separates adjacent cavities 7.

Figure 3:
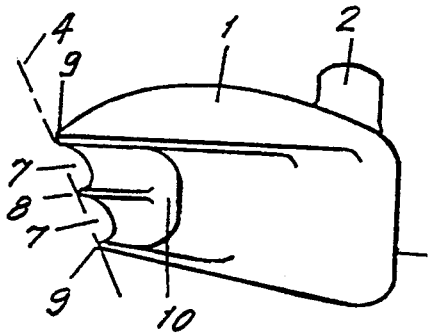
FIG. 3 is a side view of the head shown frontally in FIG. 4.
Figure 4:
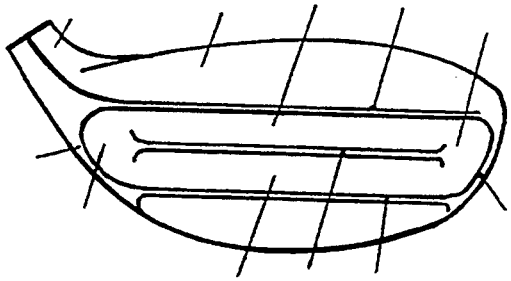
FIG. 4 is a front view of the whole rear surface 4 that is covered by the new fuselage of the present invention.

FIGS. 3 and 4 show one preferred embodiment of the invention in which the two parallel rear cavities 7 are connected on the side of the club head by a side cavity 10 to create a single continuous cavity with the same function as cavity 7.

Figure 5:
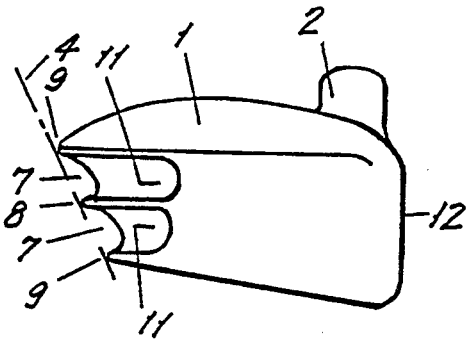
FIG. 5 is a side view of the head that is shown frontally in FIG. 6.
Figure 6:
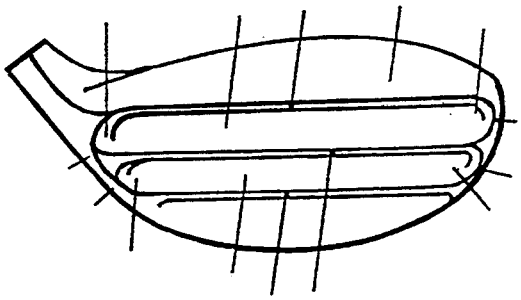
FIG. 6 is a front view of the surface 4 of the present invention.
Figure 7:
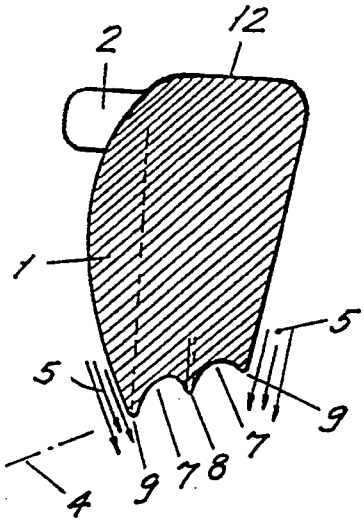
FIG. 7 is a section of the head of the golf club which is taken along the line A—A shown in top view in FIG. 8.

FIGS. 5 and 6 show a second embodiment of the invention in which the two cavities 7 remain independent and unconnected on the side of the club head, where they terminate as indicated by reference numeral 11.

In accordance with the present invention, turbulences 6 (FIG. 2) occurring beside pointed edge 9 are accommodated and held inside cavities 7, where they receive less frictional energy from the detaching fluid 5, and thus their emergence is delayed. As a result, vibrations are minimized.

The fluid swirling turbulently in vortices 6 within the cavity generates centrifugal force, the positive thrust of which minimizes drag.

In accordance with the present invention, as applied specifically to the head of a golf club, the following advantages are achieved:

Control of the air vortices.

Noticeable decrease in the vibration of the golf club.

Obvious improvement in the sensitivity of the player since, when noticeably avoiding the vibrations caused by the head of the club, the player more effectively controls the trajectory and makes the strike more effective, both with respect to the use of energy and the place where the strike must be made, thus ensuring control over the trajectory. All this also achieves a vital effect, which is the elimination of vibrations.

Although the present invention has been described in relation to particular embodiments thereof, many other variations and modifications and other uses will become apparent to those skilled in the art. Therefore, the present invention should be limited not by the specific disclosure herein, but only by the appended claims.

I claim:

1. A golf club head comprising a front face for striking a golf ball and a rear surface located opposite the front face, the rear surface having two lateral cavities separated by a central, lateral rib, and bounded by a pointed edge, the two cavities extending continuously and completely across the rear surface.

2. The golf club head of claim 1, wherein the lateral cavities separated by the central rib are joined by a connecting cavity, the lateral cavities and the connecting cavity forming a continuous cavity.

3. The golf club head of claim 1, wherein the lateral cavities cover the whole of the rear surface and are completely separated by a central rib, the lateral cavities ending in respective terminal cavities.

4. The golf club head of claim 1, wherein the central, lateral rib extends continuously and completely across the rear surface.

5. The golf club head of claim 1, wherein the two lateral cavities are parallel.

6. The golf club head of claim 1, wherein the two lateral cavities have a semi-circular shape in cross-section.

7. A golf club head comprising a front face for striking a golf ball and a rear surface located opposite the front face, the rear surface having a trailing edge for stimulating and establishing detachment of fluid flow around the golf club head, the rear surface having a shape for containing fluid vortices formed along the rear surface, the shape including a central, lateral rib, the shape being bounded by the trailing edge and extending continuously and completely across the rear surface.

8. The golf club head of claim 7, wherein the shape for containing fluid vortices is a continuous, hollow cavity surrounding the central rib and bounded by the trailing edge.

9. The golf club head of claim 7, wherein the shape for containing fluid vortices includes two lateral, parallel cavities separated by the central, lateral rib.

10. The golf club head of claim 7, wherein the shape for containing fluid vortices is substantially semi-circular in cross-section.

11. The golf club head of claim 7, wherein the trailing edge has a sharp, pointed cross-section.

* * * * *